US005467491A

United States Patent [19]

Griffith

[11] Patent Number: 5,467,491

[45] Date of Patent: Nov. 21, 1995

[54] BEDDING ANCHOR

[76] Inventor: John D. Griffith, 625 N. Kalsman Ave., Compton, Calif. 90220

[21] Appl. No.: 261,930

[22] Filed: Jun. 17, 1994

[51] Int. Cl.[6] ..... A47C 21/02

[52] U.S. Cl. ..... 5/658; 5/498; 5/925; 24/72.5

[58] Field of Search ..... 5/658, 659, 498, 5/475; 24/72.5

[56] References Cited

U.S. PATENT DOCUMENTS

| | | | |
|---|---|---|---|
| 642,236 | 1/1900 | Larimer | 5/498 |
| 1,438,475 | 12/1922 | Bisbing | 5/498 |
| 1,464,397 | 8/1923 | Royak | 5/658 |
| 4,698,880 | 10/1987 | Hamm | 5/498 |
| 4,782,543 | 11/1988 | Hutton | 5/658 |
| 5,014,399 | 7/1991 | Grisel | 5/658 |
| 5,033,139 | 7/1991 | Renfro | 5/658 |

FOREIGN PATENT DOCUMENTS

| | | | |
|---|---|---|---|
| 888806 | 12/1942 | France | 5/498 |
| 3331062 | 3/1985 | Germany | 5/498 |

*Primary Examiner*—Flemming Saether
*Attorney, Agent, or Firm*—Robert J. Schaap

[57] ABSTRACT

An improved bedding anchor, which comprises a somewhat U-shaped hook with a plastic retainer strip. An end of the bed sheet or like sheet material is wrapped around the retaining strip and the retaining strip with the end of the bed sheet wrapped therearound is inserted in the U-shaped hook. An elastic strip is connected to the hook at one end and at its other end. At the other end of the strip is a retaining pad which is preferably formed of a foam-like member, and is inserted between a box springs and a mattress. Preferably, a separate bedding anchor is located at each of the corners of a bed to retain the sheet in a taut condition.

4 Claims, 1 Drawing Sheet

BEDDING ANCHOR

BACKGROUND OF THE INVENTION

1. Field of the Invention

This invention relates in general to certain new and useful improvements in bedding anchors, and more particularly, to an improved set of bedding anchors which can operate at the corners of a bed by holding a bed sheet in a taut condition, and which also utilizes the space between the box springs and the mattress.

2. Brief Description of the Prior Art

In hospitals, rest homes and the like, where patients spend considerable periods of time in bed and, often, are unable to leave the bed for more than a short period of time, if at all, the problem of sheet wrinkles can become a major concern. These seemingly minor sheet wrinkles can cause great discomfort to the patients and tend to cause skin irritation and to create bed sores which can become infected. Hence, these wrinkled sheets may lead to serious complications after a period of time. Unfortunately, no matter how tightly the sheets are drawn, during the process of making the bed, movement of the patent will, eventually, cause some loosening of the sheet and, thereby will create wrinkles. Obviously, it is impractical to provide continual attention for every patient, so that the sheets can be re-tightened whenever wrinkles occur. However, even when such constant attention is possible, as with full-time private nursing, some wrinkling invariably occurs.

In my U.S. Pat. No. 5,092,009, I identified several problems with the prior art bedding anchors and proposals which had been presented therefor. As indicated therein, many of the prior art bedding anchors only served to retain the bed sheet at the corners of the mattress but this did little to prevent wrinkling and other dislocation of the bed sheet. One of the primary problems with the prior art bedding anchors is that they did not grasp sufficient amount of the surface area of an edge of the bed sheet and hence, rendered the prior art bedding anchors relatively ineffective for their intended purpose.

In my aforesaid U.S. Pat. No. 5,092,009, dated Mar. 3, 1992, I have provided a unique bedding anchor which did overcome many of the prior art problems. While the bedding anchor described in this U.S. Pat. No. 5,092,009 was effective, there still has been a need for a bedding anchor which is relatively easy to use and which can be quickly installed on an existing bed and easily removed therefrom when changing the bedding materials.

The prior art has revealed numerous types of bedding anchors and exemplary of this prior art are the following U.S. Patents:

| U.S. Pat. No. | Inventor | Issued |
|---|---|---|
| 2,931,084 | H. K. De Witt | April 5, 1960 |
| 2,939,195 | Carlson | June, 1960 |
| 2,988,759 | V. E. Gerdes | June 20, 1961 |
| 3,092,848 | G. B. Gronvold | June 11, 1963 |
| 3,913,186 | Ray, et al. | October, 1975 |
| 4,276,667 | B. C. Osbourne | July 7, 1981 |
| 4,660,240 | Hutton, et al. | April, 1987 |
| 4,782,543 | Hutton, et al. | November, 1988 |

Each of the aforesaid U.S. Patents suffered numerous disadvantages such as those mentioned above. Particularly, they were not effective in holding a sheet taut across the entire length of the bed and across the entire width of the bed. The bedding anchor which I propose herein accomplishes that result and moreover, is easy to use.

OBJECTS OF THE INVENTION

It is, therefore, one of the primary objects of the present invention to provide a unique bedding anchor which operates so as to hold a sheet in a taut condition by hooking onto a sheet and utilizing the weight of a mattress and an occupant to hold a retaining member between a mattress and a box spring.

It is another object to the present invention to provide a bedding anchor arrangement in which each of a plurality of bedding anchors of the type described can be used at the corners of a bed but would still hold a bed sheet in a taut condition over the length of the bed and over the width of the bed.

It is an additional object of the present invention to provide a bedding anchor of the type stated which is relatively easy to use and can easily be used by aged people or people with infirmities.

It is still another object of the present invention to provide a bedding anchor of the type stated which is relatively inexpensive to manufacture and which is highly effective for its intended purpose.

With the above and other objects in view, my invention resides in the novel features of form, construction, arrangement and combination of parts presently described and pointed out in the claims.

BRIEF SUMMARY OF THE INVENTION

A unique bedding anchor which is capable of cooperating with a plurality of like bedding anchors for retaining a bed sheet in a fairly taut condition, both over the length of the bed and over the width of a bed.

The bedding anchor of the present invention comprises a U-shaped hook, having a plastic retainer strip capable of being disposed within the trough of the hook. An edge of a bed sheet is wrapped around the plastic retainer strip, and then retentively held within the trough of the U-shaped hook by frictional engagement therein.

An elastic-type strap is connected at one end to the U-shaped hook and at its other end to a foam-like retaining pad. The retaining pad is adapted to be inserted between a box springs and a mattress. Due to the frictional engagement created by the foam material, the bed sheet is held in a fairly taut condition, even with an occupant on the bed. Indeed, when an occupant is disposed on the bed, there is a greater frictional force holding the retaining pad in a fixed position between the mattress and the box springs. As a result, the sheet is still retained in a taut condition.

This invention has many other purposes and advantages which will be made more fully apparent from a consideration of the forms in which it may be embodied. One of the forms of this unique bedding anchor is disclosed in the following detailed description of the invention and is illustrated in the drawings accompanying this present specification. However, it should be understood that this detailed description, and the accompanying drawings, are set forth only for purposes of illustrating the general principals of the invention and that the invention is not to be taken in a limiting sense.

BRIEF DESCRIPTION OF THE DRAWINGS

Figure 1:
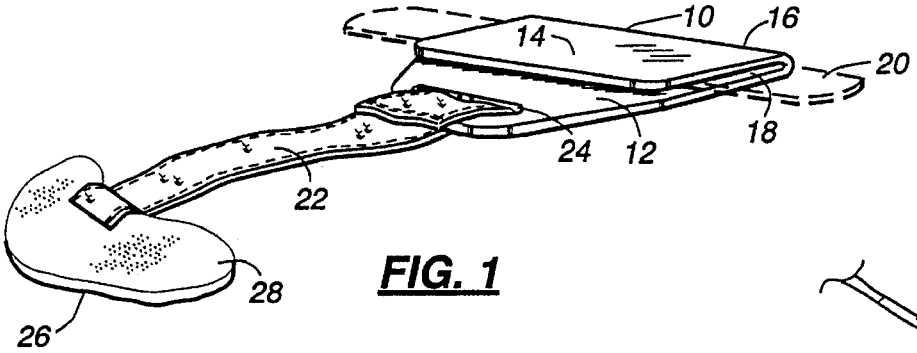
Figure 2:
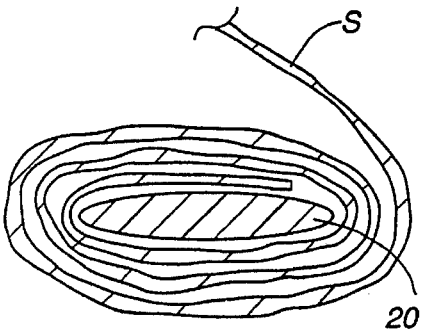
Figure 3:
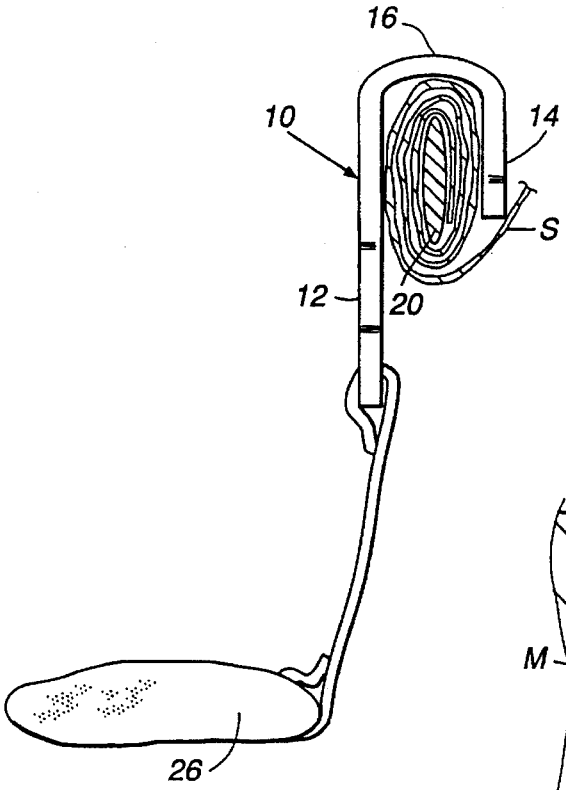
Figure 4:
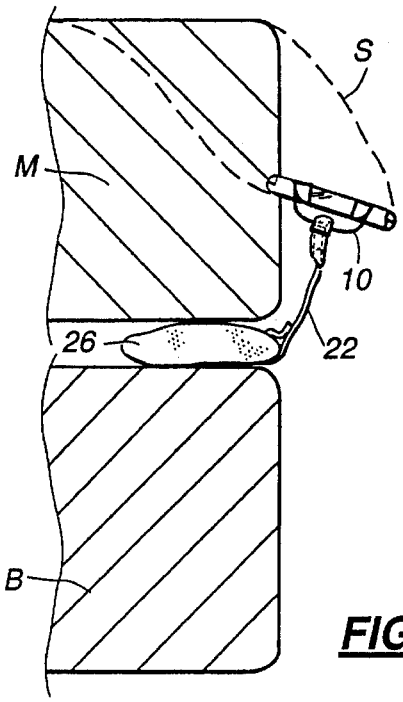

Having thus described the invention in general terms, reference will now be made to the accompanying drawings in which (one sheet):

FIG. 1 is a perspective view of a bedding anchor constructed in accordance with and embodying the present invention;

FIG. 2 sectional view showing the wrapping of a edge of a bed sheet about a plastic retaining strip forming part of the bedding anchor;

FIG. 3 is a fragmentary sectional view showing the retention of the retaining strip in the hook, forming part of the bedding anchor; and FIG. 4 is a vertical sectional view showing the disposition of a retaining pad forming part of the bedding anchor of the present invention between a box springs and a conventional mattress.

DETAILED DESCRIPTION OF PREFERRED EMBODIMENTS

Referring now in more detail and by reference characters to the drawings, which illustrate a preferred embodiment of the present invention, A designates a bedding anchor which is used in combination with a plurality of similar bedding anchors. In a preferred embodiment of the invention, four of the illustrated and described bedding anchors are provided so that one bedding anchor is used at each of the four corners of a mattress sheet. When the mattress is held by four bedding anchors in this manner, the mattress sheet is fairly taut, both lengthwise and width-wise across the bed.

The bedding anchor of the present invention generally comprises a U-shaped clip 10 having a relatively flat plate-like section 12 and an integrally formed tab connected by a bight 16. The tab 14 and bight 16, together with a portion of the plate-like section 12, form an elongate slot 18 for receiving a plastic retainer strip 20.

In the embodiment, as illustrated, the clip 10 and the retaining strip 20 are both preferably formed of a suitable plastic material, such as polystyrene, polyethylene, polypropylene, or the like. However, the clip 10 and the retaining strip 20 could be formed of any desired material, such as reinforced plastics, lightweight metals or the like.

Connected to an outer end of the plate-like section 12 is an elastic strap 22 having an end extended through a loop formed in the plate-like section 12 and secured to itself. At its opposite end, the elastic strap 22 is secured to a foam-like retaining pad 26, as best shown in FIG. 1. In the embodiment, as illustrated, the foam-like retaining pad 26 is preferably arcuately shaped, as illustrated. It has been found that this type of shape is highly effective when the retaining pad is inserted between the upper surface of a box spring B and a lower surface of a mattress M, as best illustrated in FIG. 4 of the drawing.

The foam-like retaining pad 26 is preferably formed of any suitable foam material, such as polyurethane, or the like. It has been found that a foam-like material is preferred, since it usually exhibits a sufficient amount of friction so as to be retentively retained between a mattress M and a box spring B in the manner as shown. The retaining pad 26 is provided with upper and lower flat surfaces 28, so as to maintain an effective frictional engagement with the undersurface of the mattress M and the upper surface of the box spring B. In the same respect, the retaining pad 26 could also be used with a conventional spring design, or with a platform and a mattress disposed on the platform.

When using the improved bedding anchor of the present invention, an end of a sheet S is wrapped around the plastic retainer 20 when the latter has been removed from the elongate slot 18. After a few turns of the sheet S have been wrapped around the plastic retainer strip 20, as shown in FIG. 2, the plastic retainer strip 20, along with that portion of the sheet S wrapped therearound is snugly inserted into the elongate slot 18, as best shown in FIG. 3 of the drawings. The tab 14 is somewhat yieldable so as to snugly and retentively receive the plastic retainer strip 20, along with that portion of the sheet S wrapped therearound. When so inserted in the elongate slot 18, the sheet S will be retentively held until the strip 20 is pushed outwardly from the elongate slot 18.

When it is desired to use the improved bedding anchor of the invention, the sheet S is first wrapped around the retainer strip 20, as shown in FIG. 2. Thereafter, the retaining pad 26 is inserted between the box springs B and the mattress M so that the clip 10 remains loose. Thereafter, the clip 10 with the portion of the sheet S wrapped therearound is inserted in the elongate slot 18, as shown in FIG. 3. When referring to FIG. 4, it can be seen that the sheet S is then retentively held in a very taught condition on the upper surface of the mattress M.

As indicated previously, it has been found that when utilizing four of these bedding anchors at the four corners of bed, a very taught sheet can be maintained. However, additional bedding anchors could also be used if desired. Furthermore, the bedding anchors could be located at other locations along the length and width of the mattress M.

Thus, there has been illustrated and described a unique and novel bedding anchor which fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described the invention, what I desire to claim and secure by letters patent is:

1. A bedding anchor for holding a bed sheet in a taught condition over a mattress, said bedding anchor comprising:

a) a retaining member disposed between a mattress and a support upon which the mattress is disposed;

b) an elastic strap connected to said retaining member and extending outwardly from the position between an undersurface of the mattress and the support;

c) a generally U-shaped clip having a pair of resilient relatively straight spaced apart arms connected by a bight section connected to an outer end of said elastic strap and which arms can be resiliently spread apart to allow access to a recess formed between the arms and thereafter elastically return to their original position, one arm of said clip is longer than the other arm and the elastic strap is connected to the longer of the arms at an end opposite the bight section; and d) a retainer strip for wrapping about an edge portion of the sheet for a plurality of turns therearound and which is sized to be removably disposed and retentively held within said clip, said clip and the turns of the sheet wrapped therearound being sufficiently thick to cause the clip means to retentively hold the edge portion of the sheet therein, such that a plurality of said bedding anchors, when connected to said sheet, and having their respective retaining members disposed between the undersurface of the mattress and the support, will hold a sheet in a taught position.

2. The bedding anchor of claim 1 further characterized in that said retaining member is a plastic foam retaining member.

3. The bedding anchor of claim 1 further characterized in that said retaining member is disposed between a mattress and a box spring for a bed.

4. The bedding anchor of claim 3 further characterized in that said retaining member is a foam plastic retaining member having a high coefficient of friction with the box spring and the mattress.

* * * * *